US006506548B1

(12) United States Patent
Klaus et al.

(10) Patent No.: US 6,506,548 B1
(45) Date of Patent: Jan. 14, 2003

(54) SILVER HALIDE PHOTOGRAPHIC MATERIALS CONTAINING SOLUBILIZED ANTIFOGGANTS

(75) Inventors: Roger L. Klaus, Victor, NY (US); George J. Burgmaier, Pittsford, NY (US); Jon N. Eikenberry, Rochester, NY (US); Jerzy Z. Mydlarz, Fairport, NY (US); Nicholas E. Grzeskowiak, Hertford (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/014,990

(22) Filed: Dec. 11, 2001

(51) Int. Cl.[7] ..... G03C 1/34; G03C 7/392

(52) U.S. Cl. ..... 430/551; 430/607; 430/611; 430/598; 430/617

(58) Field of Search ..... 430/607, 611, 430/610, 617, 551, 598

(56) References Cited

U.S. PATENT DOCUMENTS

| | | | | | |
|---|---|---|---|---|---|
| 3,874,946 | A | * | 4/1975 | Costa et al. | 430/617 |
| 3,946,007 | A | | 3/1976 | Goralski et al. | 260/247.1 |
| 5,958,668 | A | * | 9/1999 | Matsumoto et al. | 430/611 |
| 6,074,813 | A | * | 6/2000 | Asanuma et al. | 430/607 |
| 6,350,569 | B1 | * | 2/2002 | Watanabe et al. | 430/617 |

OTHER PUBLICATIONS

Hans Pritzkow et al, Darstellung perhalogenierter Mesylsulfene, $X_3C–SO_2–C(X)=SO_2$, und ihre Stabilisierung durch Chinuchlidin, Feb. 1990, pp. 1187–1192.

Bruce B. Jarvis et al, J. Org. Chem., vol. 40, No. 25, 1975, pp. 3778–3780.

Dieter Scholz, Neue Synthesemethoden, 10, Liebigs Ann. Chem., 1984, pp. 264–272.

Udo Rheude et al, "Uber Reaktionen halogenierter Methansulfonylchloride mit Trimethylamin und ein inverses Sulfen–Amin–Addukt", Chem. Ber. 118, 1985, pp. 2208–2219.

George J. Burgmaier et al U.S. application Ser. No. 10/014961 "Photothermographic Materials Containing Solubilized Antifoggants" (Docket 81832/JLT).

Kenneth J. Reed et al U.S. application Ser. No. 10/014704 "Silver Halide Elements Containing Solubilized Antifoggants and Low Fogging Tabular Silver Halide Grains" (Docket 82988/SMR).

George J. Burgmaier et al U.S. application Ser. No. 10/014223 "Water Soluble Halogen Containing Compounds" (Docket 83636/SMR).

* cited by examiner

*Primary Examiner*—Richard L. Schilling
(74) *Attorney, Agent, or Firm*—Sarah Meeks Roberts

(57) ABSTRACT

This invention relates to a silver halide photographic element comprising at least one silver halide emulsion layer and further comprising an antifoggant represented by the following Structure I:

$$R_1—SO_2—C(R_2)R_3—(CO)_m—(L)_n—SG \quad \text{I}$$

wherein $R_1$ is an aliphatic or cyclic group, $R_2$ and $R_3$ are independently hydrogen or bromine as long as at least one of them is bromine, L is a divalent linking group, m and n are independently 0 or 1, and SG is a solubilizing group that has a pKa of 8 or less.

26 Claims, No Drawings

SILVER HALIDE PHOTOGRAPHIC MATERIALS CONTAINING SOLUBILIZED ANTIFOGGANTS

FIELD OF THE INVENTION

This invention relates to silver halide photographic materials containing solubilized antifoggants. More specifically it relates to non-photothermographic silver halide materials containing solubilized antifoggants.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "D-min", the density obtained in the unexposed portions of the emulsion. Density, as normally measured, includes both that produced by fog and that produced as a function of exposure to light. It is known in the art that the appearance of photographic fog related to intentional or unintentional reduction of silver ion (reduction sensitization) can occur during many stages of preparation of the photographic element including silver halide emulsion preparation, spectral/chemical sensitization of the silver halide emulsion, melting and holding of the liquid silver halide emulsion melts, subsequent coating of silver halide emulsions, and prolonged natural and artificial aging of coated silver halide emulsions. The chemicals used for preventing fog growth as a result of aging or storage are generally known as emulsion stabilizers.

The control of fog, whether occurring during the formation of the light-sensitive silver halide emulsion, during the spectral/chemical sensitization of those emulsions, during the preparation of silver halide compositions prior to coating on an appropriate support, or during the aging of such coated silver halide compositions, has been attempted by a variety of means. Mercury-containing compounds, such as those described in U.S. Pat. Nos. 2,728,663; 2,728,664; and 2,728,665, have been used as additives to control fog. Thiosulfonates and thiosulfonate esters, such as those described in U.S. Pat. Nos. 2,440,206; 2,934,198; 3,047,393; and 4,960,689, have also been employed. Organic dichalcogenides, for example, the disulfide compounds described in U.S. Pat. Nos. 1,962,133; 2,465,149; 2,756,145; 2,935,404; 3,184,313; 3,318,701; 3,409,437; 3,447,925; 4,243,748; 4,463,082; and 4,788,132 have been used not only to prevent formation of fog, but also as desensitizers and as agents in processing baths and as additives in diffusion transfer systems.

However, despite all the efforts in this field there still remains a need for compounds which act as effective antifoggants in photographic elements which are stored under high temperature conditions. There is particularly a need for antifoggants which are water soluble and, thus, are safer to utilize during manufacture of the photographic elements.

SUMMARY OF THE INVENTION

This invention provides a silver halide photographic element comprising at least one silver halide emulsion layer and further comprising an antifoggant represented by the following Structure I:

$$R_1—SO_2—C(R_2)R_3—(CO)_m—(L)_n—SG \quad \text{I}$$

wherein $R_1$ is an aliphatic or cyclic group, $R_2$ and $R_3$ are independently hydrogen or bromine as long as at least one of them is bromine, L is a divalent linking group, m and n are independently 0 or 1, and SG is a solubilizing group with a pKa of 8 or less. This invention further provides silver halide emulsions comprising said antifoggants.

The photographic elements of this invention demonstrate reduced fogging during chemical sensitization and enhanced fog retardation of liquid emulsions during high temperature holding. The water soluble antifoggants minimize the need for expensive and time-consuming preparation of solid-particle dispersions, as well as minimize the need for volatile organic solvents. Use of these materials also eliminates the need to use environmentally undesirable heavy metal antifoggant salts such as mercuric salts.

DETAILED DESCRIPTION OF THE INVENTION

The silver halide photographic elements of this invention include one or more water-soluble or water-dispersible antifoggants containing a solubilizing group with a pKa of 8 or less. These compounds are represented by the following Structure I:

$$R_1—SO_2—C(R_2)R_3—(CO)_m—(L)_n—SG \quad \text{I}$$

wherein $R_1$ is a substituted or unsubstituted aliphatic or cyclic group of any size as long as the antifoggant remains soluble or readily dispersible in water. Substituted or unsubstituted aliphatic groups for $R_1$ include monovalent groups having 1 to 20 carbon, nitrogen, sulfur, and oxygen atoms in the chain including, but not limited to, chains that include one or more substituted or unsubstituted alkyl groups having 1 to 10 carbon atoms, substituted or unsubstituted alkenylene groups having 2 to 20 carbon atoms, substituted or unsubstituted alkylenearylene groups having 7 to 20 carbon atoms in the chain, and combinations of any of these groups, as well as combinations of these groups that are connected with one or more amino, amido, carbonyl, sulfonyl, carbonamido, sulfonamido, thio, oxy, oxycarbonyl, oxysulfonyl, and other connecting groups that would be readily apparent to one skilled in the art. The various types of useful aliphatic groups would be readily apparent to one skilled in the art. Preferred aliphatic groups for $R_1$ include substituted or unsubstituted t-butyl groups and trifluoromethyl groups.

$R_1$ can also be substituted or unsubstituted cyclic groups including substituted or unsubstituted carbocyclic aryl groups having 6 to 14 carbon atoms to form the cyclic ring, substituted or unsubstituted cycloalkylene groups (having 5 to 10 carbon atoms to form the cyclic ring), and heterocyclic groups (having 5 to 10 carbon, nitrogen, sulfur, or oxygen atoms to form the cyclic ring), both aromatic and non-aromatic. The various types of cyclic groups would be readily apparent to one skilled in the art.

Preferred cyclic groups for $R_1$ include substituted or unsubstituted aryl groups having 6 to 10 carbon atoms to form the cyclic ring. Substituted or unsubstituted phenyl groups are most preferred. Methyl groups are preferred substituents on the phenyl group.

In Structure I, $R_2$ and $R_3$ are independently hydrogen or bromine as long as one of them is bromine. Preferably, both $R_2$ and $R_3$ are bromine.

In addition, L is a substituted or unsubstituted divalent linking group, and more preferably an aliphatic linking group that can have the same definition as $R_1$ except that L is divalent. Thus, one skilled in the art would be able to determine suitable L groups that would serve the desired purpose while maintaining compound water solubility or dispersibility. Preferably, L is —NH-alkylene wherein "alkylene" is substituted or unsubstituted and has 1 to 10 carbon atoms (more preferably 1 to 3 carbon atoms).

Substituents on $R_1$ and L can be any chemical moiety that would not adversely affect the desired function of the antifoggant and can include, but are not limited to, alkyl, aryl, heterocyclic, cycloalkyl, amino, carboxy, hydroxy, phospho, sulfonamido, sulfo, halo, and other groups that would be readily apparent to one skilled in the art. The number of substituents is limited only by the number of available valences (available hydrogen atoms). Alkyl groups are preferred substituents for cyclic $R_1$ groups. However, as would be apparent, the antifoggants can have multiple sulfo, carboxy, phospho, and sulfonamido groups that impart water solubility to the molecule. Further, in Structure I, m and n are independently 0 or 1, and preferably, both are 1.

SG can be any suitable solubilizing group which has a pKa of 8 or less and which does not interfere with the antifogging activity of the compound. SG may be in the free acid form or it may be a salt, particularly a suitable metal (for example, alkali metal salt) or ammonium ion salt. Preferably, SG is a salt. When SG is in its free acid form, the salt can be generated in situ by neutralization with any basic material commonly used by one skilled in the art. Preferably SG is a carboxy, phospho, sulfo, or sulfonamido group. When SG is a sulfonamido group, it may be $—SO_2N^-COR_4M^+$, or $—NSO_2R_4M^+$ with $R_4$ being a substituted or unsubstituted aliphatic or cyclic group that is defined the same as for $R_1$, although $R_1$ and $R_4$ can be the same or different in a particular compound. Preferably, SG is a carboxy or sulfo group (or salts thereof, particularly when both m and n are 1.

$M^+$ is a suitable cation such as a metal cation (preferably alkali metal ion) or an ammonium ion. When $M^+$ is a hydrogen atom, the resulting free acid can be easily solubilized by neutralization with any convenient base, such as, for example, potassium hydroxide or sodium bicarbonate.

Representative antifoggants useful within the practice of this invention include the following compounds:

A-1

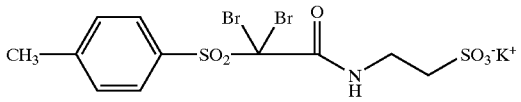

A-2

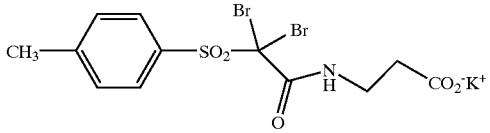

A-3

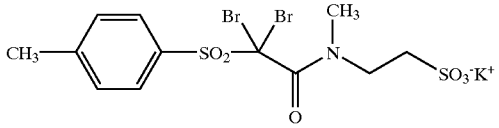

-continued

A-4

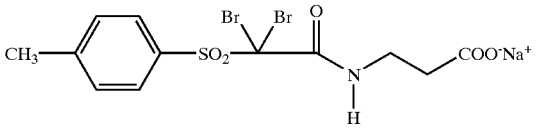

A-5

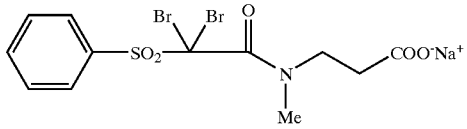

A-6

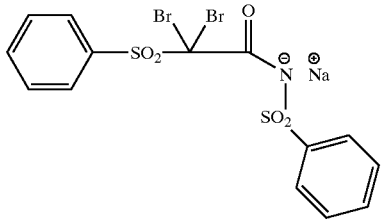

A-7

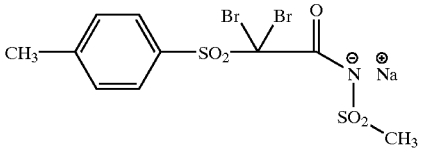

A-8

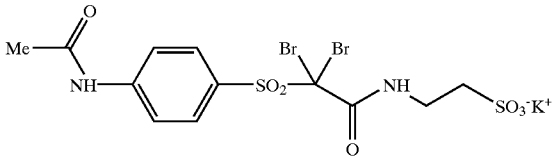

A-9

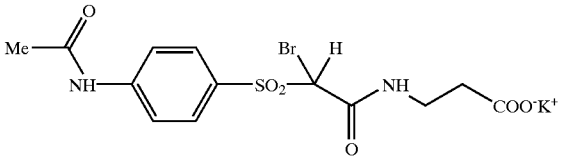

A-10

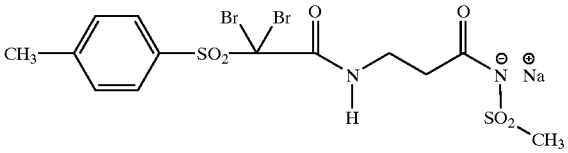

A-11

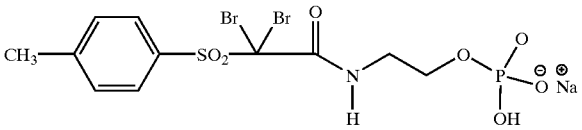

A-12

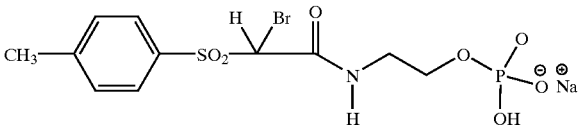

-continued

A-13

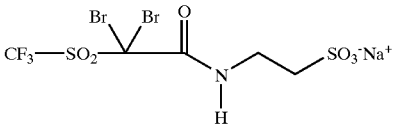

A-14

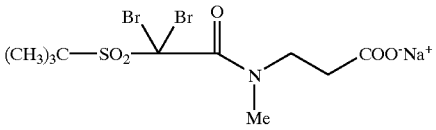

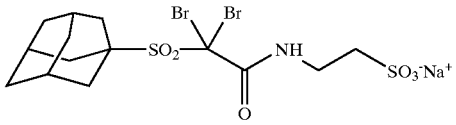

A-16

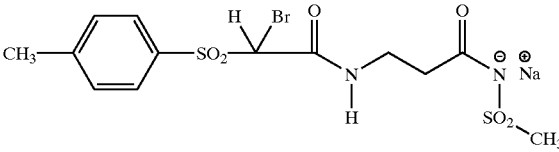

A-17

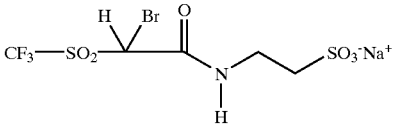

A-18

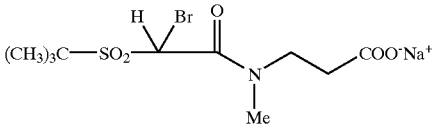

A-19

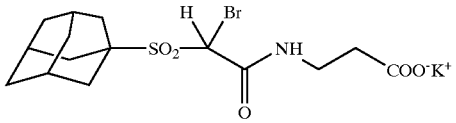

A-20

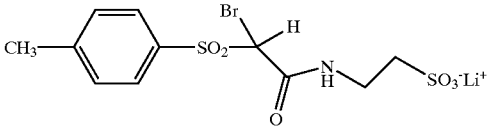

A-21

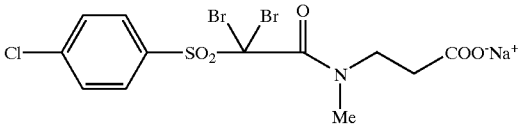

A-22

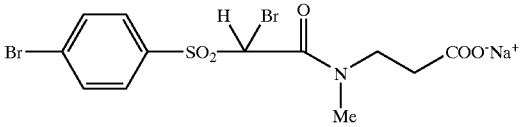

-continued

A-23

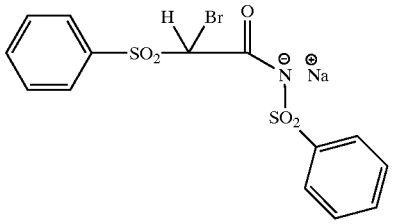

A-24

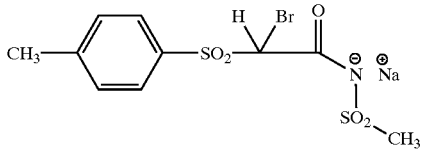

A-25

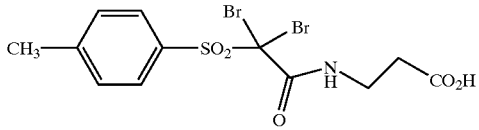

A-26

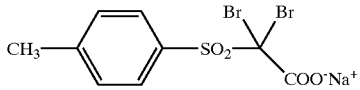

A-27

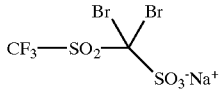

A-28

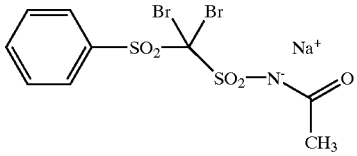

A-29

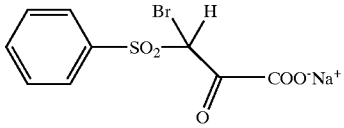

A-30

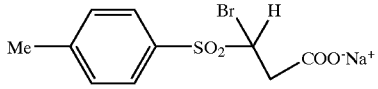

A-31

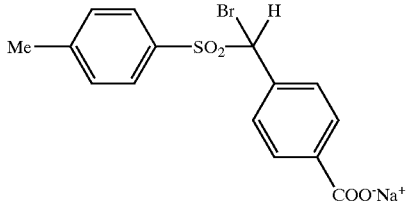

The compounds represented by Structure I can be prepared using starting materials and procedures that would be readily apparent to one skilled in the art. For example, compounds wherein m is 1 (and n is 0 or 1) can be prepared by reacting a salt of a sulfinic acid (such as p-toluenesulfinic acid, sodium salt) with a 2-bromomethylcarbonyl derivative, followed by bromination of the resulting sulfone using molecular bromine or another suitable brominating agent.

Instead of using the salt of a sulfinic acid, an aromatic or aliphatic thiol can be condensed with the 2-bromomethylcarbonyl derivative followed by oxidation of the thioether to a sulfone and then subsequent bromination.

Some 2-bromomethylcarbonyl derivatives can be prepared by reacting bromoacetylbromide with amines such as taurine, as described in U.S. Pat. No. 5,091,298 (Parton et al), with glycine, as described in the Journal of the Korean Society of Textile Engineers and Chemists, p 13, December 1981 (Hwang et al), or with methanesulfonamide, as described in U.S. Pat. No. 5,620,989 (Harrison et al).

Monobromination can be achieved by using only one equivalent of a source of bromine, using a less active brominating agent, or by adjusting reaction conditions as one skilled in the art would readily understand.

By "water-soluble" or "water-dispersible" in defining the antifoggants is meant that the compounds are readily dissolved or dispersed in water. Therefore, their use in silver halide emulsions and photographic elements alleviates the need for volatile organic solvents and circumvents the disadvantages of using solid particle dispersions. In order to be "water-soluble" or "water-dispersible", it should be possible to add between 0.1 g and 500 g of the antifoggant to 1000 mL of water. Optimally, it should be possible to add between 50 g and 200 g of the antifoggant to 1000 mL of water The antifoggants can be used individually or in combination in the elements of this invention. Generally, they are present in an amount of at least 0.0001 mol/mol of total silver. Preferably, they are present in an amount of from about 0.001 to about 0.1 mol/mol of total silver.

The antifoggant compounds may be added to any layer where they are in reactive association with the silver halide. By "in reactive association with" it is meant that the compounds must be contained in the silver halide emulsion layer or in a layer whereby they can react or interact with, or come in contact with, the silver halide emulsion. Preferably, the antifoggants are included in the one or more emulsion layers, but during manufacture, they can also be incorporated into interlayers, underlayers, and protective topcoat layers on the frontside of the support. If they are placed in a non-emulsion layer, they tend to migrate into the emulsion layer(s) where they become effective in reducing $D_{min}$. The antifoggant compounds may be added to the photographic emulsion using any technique suitable for this purpose.

The photographic emulsions used in this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The antifoggants may be added to the silver halide emulsion at any time during the preparation of the emulsion, i.e., during precipitation, during or before chemical sensitization, or during final melting and co-mixing of the emulsions and additives for coating. More preferably, these compounds are added after precipitation and washing and most preferably during or directly after chemical sensitization of the final melt.

The antifoggants may be utilized in addition to any conventional emulsion stabilizer or antifoggant as commonly practiced in the art. Combinations of the antifoggants of the invention may also be utilized.

The elements of the invention are photographic elements as opposed to photothermographic elements. The imaging arts have long recognized that the field of photothermography is clearly distinct from that of photography. Photothermographic materials differ significantly from conventional silver halide photographic materials that require processing with aqueous processing solutions to provide a visible image.

In photothermographic imaging materials, a visible image is created solely by heat as a result of the reaction of a developer incorporated within the material. Heating at 50° C. or more is essential for this dry development. In contrast, conventional photographic imaging materials require contact with an aqueous processing solution. Heat may be utilized in addition to the processing solution but at more moderate temperatures (generally from 30° C. to 50° C.) to provide a visible image.

In photothermographic materials, all of the "chemistry" for imaging is incorporated within the material itself For example, such materials include a developer (that is, a reducing agent for the reducible silver ions) while conventional photographic materials usually do not. Even in so-called "instant photography", the developer chemistry is physically separated from the photosensitive silver halide until development is desired. Moreover, in photothermographic materials, the unexposed silver halide generally remains intact after development and the material must be stabilized against further imaging and development. In contrast, silver halide is removed from conventional photographic elements after solution development to prevent further imaging (that is, in the aqueous fixing step).

The antifoggants of this invention are used in silver halide photographic elements wherein processing is initiated, at least in part, using an aqueous processing solution, as opposed to using solely heat. The silver halide photographic elements of the invention may utilize either low volume processing systems or conventional processing systems.

Low volume systems are those where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing. Conventional photographic systems are those where film elements are processed by contact with conventional photographic processing solutions, and the volume of such solutions is very large in comparison to the volume of the imaging layer.

Low volume processing is defined as processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume system photographic element may receive some or all of the following treatments:

(I) Application of a solution directly to the film by any means, including spray, inkjet, coating, gravure process, and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in an image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Conventional photographic elements in accordance with the invention can be processed in any of a number of well-known photographic processes utilizing any of a number of well-known conventional photographic processing solutions, described, for example, in the *Research Disclosures* referenced hereafter, or in T. H. James, editor, *The Theory of the Photographic Process,* 4th Edition, Macmillan, New York, 1977. The development process may take place for any length of time and any process temperature that is suitable to render an acceptable image.

Some common black-and-white developing agents include the p-aminophenols, such as Metol, the polyhydroxybenzenes such as hydroquinone and catechol, the pyrazolidones (phenidones), and ascorbic acid. These developers may be utilized alone or in combination. In black-and-white processing the development step is generally followed by a fixing step and optionally a washing step.

In the case of processing a negative working color element, the element is treated with a color developer (that is, one which will form the colored image dyes with the color couplers), and then with a oxidizer and a solvent to remove silver and silver halide. In the case of processing a reversal color element, the element is first treated with a black-and-white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino-N,N-diethylaniline hydrochloride, 4-amino-3-methyl-N,N-diethylaniline hydrochloride, 4-amino-3-methyl-N-ethyl-N-(2-(methanesulfonamido) ethylaniline sesquisulfate hydrate, 4-amino-3-methyl-N-ethyl-N-(2-hydroxyethyl)aniline sulfate, 4-amino-3-α-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing to remove silver or silver halide, washing, and drying.

Other processing methods useful with the current invention include less conventional processors such as those described in U.S. Pat. No. 5,890,028, a drum processor such as the Kodak RS-11 Drum Processor, or a wave processor which processes a photographic material by loading the material into a chamber, introducing a metered amount of processing solution into the chamber, and rotating the chamber in a fashion which forms a wave in the solution through which the material passes. The appropriate solution for each processing stage is added and removed sequentially from the processing space and can be treated for disposal as described in the current invention. The wave processor is described in more detail in U.S. application Ser. No. 09/920,495, filed Aug. 1, 2001.

Another processor and processing method with which the current invention is particularly useful is the merged process described in U.S. application Ser. No. 10/012,673 filed Oct. 30, 2001 of Peter J. Twist titled "Processing Photographic Material". This processing method for silver halide photographic material comprises loading the material into a chamber, introducing a metered amount of a first processing solution into the chamber, and processing the photographic material with the first processing solution. It then comprises introducing a metered amount of a second processing solution into the chamber without removing the first processing solution so that at least part of the whole volume of the second processing solution is provided by the first processing solution and processing the photographic material with the second processing solution. The merged method further comprises, after processing the photographic material with the second processing solution, introducing a metered amount of a third processing solution into the chamber without removing any processing solution remaining from the preceding processing solution or solutions so that at least part of the total volume of the third processing solution is provided by the preceding processing solution or solutions and processing the photographic material with the third processing solution.

Using the merged solution processing method it is possible to add all of the processing solutions except the wash solution on top of one another in the correct sequence without removing the previous solution. Thus, the whole of the previous solution is mixed with the next solution. The method is preferably carried out in a high agitation single use processor which processes one film at a time with small volumes similar to those used to replenish continuous processors with tanks of several liters. Thus, a developer solution may be added to the tank of the single use processor, and after development is complete, a bleach solution, for example, is added to the developer solution to transform the developer into a bleach solution, then a fix solution is added to the developer plus bleach solution to convert it into a bleach-fix solution. The previous solution acts as a diluent for the next solution which means that the next solution can be more concentrated than it would be if it were used alone. This means that the total volume used in the process can be less than that used if each solution is removed after the particular stage it performs is complete.

With negative-working silver halide, the processing steps provide a negative image. One type of such element, referred to as a color negative film, is designed for image capture. Speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

Another type of color negative element is a color print. Such an element is designed to receive an image optically printed from an image capture color negative element. A color print element may be provided on a reflective support for reflective viewing (e.g., a snapshot) or on a transparent support for projection viewing as in a motion picture. Elements destined for color reflection prints are provided on a reflective support, typically paper, employ silver chloride emulsions, and may be optically printed using the so-called negative-positive process where the element is exposed to light through a color negative film which has been processed as described above. The element is sold packaged with instructions to process using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic elements can be black and white such as radiographic films, aerial films, black-and-white motion picture films, duplicating and copy films, graphic arts films, positive- and negative-working microfilms, and amateur and professional continuous tone black-and-white films. The antifoggants are particularly suitable for use in graphic arts films which develop to give very high image quality "hard dots" through use of hydrazide nucleating agents coated in the film. Hydrazide nucleating agents are well known to those skilled in the art. Some suitable hydrazide nucleating agents are described in U.S. Pat. Nos. 6,143,462; 6,228,566; and 6,245,480; GB Application No. 0102880.2 filed Feb. 6, 2001 and GB Application 0014329.7 filed Jun. 12, 2000. These bring about ultra high contrast by reacting with oxidized developer from initially developing light-imaged grains to generate agents which trigger developability of the immediately adjacent grains. It is especially necessary that the silver halide emulsions used in such films have a low level of fogged grains, i.e., those developable without first receiving light exposure, because the amplification caused by the nucleating agents can otherwise cause microscopic black spots known as "pepper fog", which degrade the image. The solubilized antifoggants of the invention are particularly useful in such high contrast elements when used in combination with dichalcogenide antifoggants such as those described in U.S. Pat. Nos. 5,219,721 and 5,418,127.

The elements of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire PO10 7DQ, ENGLAND, the contents of which are incorporated herein by reference. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, morphology |
| 2 | I, II, IX, X, XI, XII, XIV, XV | and preparation. Emulsion preparation including hardeners, |
| 3 & 4 | I, II, III, IX A & B | coating aids, addenda, etc. |
| 1 | III, IV | Chemical sensitization and |
| 2 | III, IV | spectral sensitization/ |
| 3 & 4 | IV, V | Desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; Developing |
| 2 | XIX, XX, XXII | agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

Photographic silver halide elements utilize more silver halide than do photothermographic materials. In photothermographic materials, only a small amount of silver halide is used to capture light and a non-photosensitive source of reducible silver ions (for example, a silver carboxylate) is used to generate the visible image using thermal development. Thus imaged, the photosensitive silver halide serves as a catalyst for the physical development process involving the non-photosensitive source of reducible silver ions and the incorporated reducing agent. In contrast, conventional wet-processed photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials. Additionally the silver halide to organic Ag salt ratio is very different for the two types of imaging materials. The two are defined as follows. AgX is all the silver halide in an element either added via ex-situ methods (preformed AgX) or generated in-situ by addition of free halide to the organic silver salt. AgR is the reducible silver ions coming from a non-photosensitive source. In conventional photographic elements AgX/AgR is always greater than 1 on a mass basis or a mass/surface area basis. In photothermographic systems AgX/AgR is always less than 1 on a mass basis or a mass/surface area basis. Therefore, the silver halide photographic elements of the invention generally have, over the multiplicity of element layers, a ratio of AgX/AgR>1 and photothermographic systems generally have, over the multiplicity of element layers, a ratio of AgX/AgR<1.

These and other distinctions between photothermographic and photographic materials are described in *Imaging Processes and Materials* (Neblette's Eighth Edition), noted above, *Unconventional Imaging Processes,* E. Brinckman et al (Eds.), The Focal Press, London and New York, 1978, pp. 74–75, in Zou et al, *J. Imaging Sci. Technol.* 1996, 40, 94–103, and in M. R. V. Sahyun, *J. Imaging Sci. Technol.* 1998, 42, 23.

The silver halide emulsions utilized may be of any silver halide composition, including but not limited to silver bromide, silver bromoiodide, silver chloride, silver chlorobromide, and silver chloroiode. Preferably the silver halide emulsions utilized in this invention are bromoiodide emulsions.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520; Wilgus et al U.S. Pat. No. 4,434,226; Solberg et al U.S. Pat. No. 4,433,048; Maskasky U.S. Pat. Nos. 4,435,501; 4,463,087; and 4,173,320; Daubendiek et al U.S. Pat. Nos. 4,414,310 and 4,914,014, Sowinski et al U.S. Pat. No. 4,656,122; Piggin et al U.S. Pat. Nos. 5,061,616 and 5,061,609; Tsaur et al U.S. Pat. Nos. 5,147,771; '772; '773; 5,171,659; and 5,252,453; Black et al U.S. Pat. Nos. 5,219,720 and 5,334,495; Delton U.S. Pat. Nos. 5,310,644; 5,372,927; and 5,460,934, Wen U.S. Pat. No. 5,470,698; Fenton et al U.S. Pat. No. 5,476,760; Eshelman et al U.S. Pat. Nos. 5,612,175; and 5,614,359; and Irving et al U.S. Pat. No. 5,667,954.

Ultrathin high bromide {111} tabular grain emulsions are illustrated by Daubendiek et al U.S. Pat. Nos. 4,672,027; 4,693,964; 5,494,789; 5,503,971; and 5,576,168; Antoniades et al U.S. Pat. No. 5,250,403; Olm et al U.S. Pat. No. 5,503,970; Deaton et al U.S. Pat. No. 5,582,965; and Maskasky U.S. Pat. No. 5,667,955. High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215; Wey et al U.S. Pat. No. 4,414,306; Maskasky U.S. Pat. Nos. 4,400,463; 4,713, 323; 5,061,617; 5,178,997; 5,183,732; 5,185,239; 5,399,478 and 5,411,852; and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337; 5,292,632; 5,275,930 and 5,399,477; House et al U.S. Pat. No. 5,320,938; Brust et al U.S. Pat. No. 5,314,798; Szajewski et al U.S. Pat. No. 5,356,764; Chang et al U.S. Pat. Nos. 5,413,904 and 5,663,041, Oyamada U.S. Pat. No. 5,593,821; Yamashita et al U.S. Pat. Nos. 5,641,620 and 5,652,088; Saitou et al U.S. Pat. No. 5,652,089; and Oyamada et al U.S. Pat. No. 5,665,530. Ultrathin high chloride {100} tabular grain emulsions can be prepared by nucleation in the presence of iodide, following the teaching of House et al and Chang et al, cited above.

When the silver halide element is a color element it also contains at least one dye forming coupler which reacts with oxidized color developer to form image dye. Image dye-forming couplers which may be included in the element such as couplers that form cyan dyes upon reaction with oxidized color developing agents are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

The Photographic elements of the invention can be exposed to actinic radiation, typically in the visible region of the spectrum, to form a latent image and can then be processed to form a visible dye image as already described above. The elements as discussed above may serve as origination material for image scanning to produce an electronic rendition of the capture image, and subsequent digital processing of that rendition to manipulate, store, transmit, output, or display electronically that image. A number of modifications of color negative elements have been suggested for accommodating scanning, as illustrated by *Research Disclosure,* September 1994, Item 36544, and *Research Disclosure,* September 1996, Item 38957, Section XIV. Scan facilitating features. These systems to the extent compatible with the color negative element constructions described above are contemplated for use in the practice of this invention. Further examples of such processes and useful film features are also described in U.S. Pat. Nos. 5,840,470; 6,045,938; 6,021,277; EP 961,482 and EP 905,651.

The following examples are intended to illustrate, but not to limit, the invention.

Preparative Examples

EXAMPLE 1

Inventive Antifoggant A-1

Antifoggant A-1 is 2,2'-dibromo-(4-methylphenyl) sulfonyl-N-(2-sulfoethyl)acetamide potassium salt, and has the structure shown above. Compound A-1 was prepared as follows:

To a 5-liter flask equipped with a mechanical stirrer and reflux condenser was addedp-toluenesulfinic acid, lithium salt (308.57 g), N-(2-sulfoethyl)-2-bromoacetamide, lithium salt (527.39 g), water (180 ml), and ethyl alcohol (3380 ml). The resulting suspension was heated to reflux. After about an hour of reflux, nearly all of the reactants had dissolved. Reflux was continued another four hours, and the solution was filtered hot through a Celite pad to remove some haziness. The solution was cooled overnight to room temperature. The solid that formed was collected and washed with 1 liter of 95% ethyl alcohol/water. The white solid was air dried and then dried at high vacuum, providing 553.88 g (89% yield) of 2-(4-methylpbenyl)sulfonyl-N-(2-sulfoethyl) acetamide, lithium salt (Intermediate 1). HPLC analysis showed no detectable impurities. Ion chromatography indicated 0.035 weight % bromide and 1.8 weight % lithium. The material exhibited an acceptable proton spectrum.

To glacial acetic acid (660 ml) was added Intermediate 1 (98.19 g), and 1,3-dibromo-5,5-dimethylhydantoin (42.89 g). The resulting suspension was heated to reflux where solution occurred. After about 3–5 minutes at reflux, the slight bromine color was discharged, and reflux was continued to another 15 minutes. Analysis of the reaction mixture by HPLC indicated conversion to one main product. After cooling to near room temperature, most of the acetic acid was removed on the rotary film evaporator using a water aspirator (water bath temperature at 40° C.). The residue was diluted with 2500 ml of ethyl alcohol. Complete solution occurred after stirring the suspension for one hour at room temperature. To this stirring solution at room temperature was added dropwise a solution of potassium acetate (58.88 g) dissolved in ethyl alcohol (500 ml). A white solid formed immediately. Upon complete addition of the potassium acetate solution, the suspension was stirred at room temperature for 90 minutes, and the desired antifoggant A-1,2,2-dibromo-2-(4-methylphenyl)sulfonyl-N-(2-sulfoethyl)acetamide, potassium salt, was collected by filtration and washed with ethyl alcohol. The solid was then dried under high vacuum at 40° C. The yield of crude antifoggant A-1, which had a slight odor of acetic acid, was 145.22 g (94%).

Two separate synthetic batches of A-1 were made, combined, and recrystallized by dissolving 182.33 g of product in a mixture of water (85 ml) and ethyl alcohol (600 ml) while boiled, filtered hot, and adding about 7 ml water upon cooling to prevent oiling. After letting the solution stand overnight at room temperature, the desired antifoggant product was collected and washed with about 300 ml (10:1 v/v) ethyl alcohol/water mixture. The product was then air-dried and then dried under high vacuum at 40° C., providing 159.87 g of desired product. HPLC analysis indicated an assay of 99.2% of the desired component. The product exhibited the expected proton nmr spectrum and mass spectrum consistent with the A-1 structure shown above.

EXAMPLE 2

Inventive Antifoggant A-2

Inventive antifoggant A-2 is 2,2'-dibromo-(4-methylphenyl)-sulfonyl-N-(2-carboxyethyl)acetamide, potassium salt, and has the structure noted above. Compound A-2 was prepared similarly to Compound A-1 except that the N-(2-sulfoethyl)-2-bromoacetamide, lithium salt is replaced by the HCl salt of the ethyl ester of β-alanine. The resulting substituted bromoacetamide is reacted as above with the sodium salt of toluenesufinic acid followed by alkaline hydrolysis of the ester and subsequent reaction with bromine to form A-2.

EXAMPLE 3

Inventive Antifoggant A-7

Inventive antifoggant A-7 was prepared similarly to Compound A-1 except that N-bromoacetylmethanesulfonamide was reacted with the sodium salt of toluenesulfinic acid, followed by bromination with molecular bromine.

EXAMPLE 4

Inventive Antifoggant A-20

Inventive antifoggant A-20 is 2-bromo-2-(4-methylphenyl)-sulfonyl-N-(2-sulfoethyl)acetamide lithium salt, and has the structure drawn above. Compound A-20 was prepared as follows:

To glacial acetic acid (125 ml) was added Intermediate 1 (18.66 g), and the suspension was heated in an oil bath at a temperature of 52° C. To the stirring suspension was added dropwise over a 5 hr. period a solution of bromine (14.77 g) dissolved in glacial acetic acid (15 ml). Upon complete addition, the temperature of the oil bath was maintained at 52° C. for 75 min., and then the heat was removed. Upon standing at room temperature, solid formed. The product was collected and washed sequentially with glacial acetic acid and acetonitrile and dried in a vacuum oven, obtaining 20.21 g of a white solid. The material was further purified by dissolving the solid (17.30 g) at the boil in 200 ml acetonitrile containing 4 ml water, and then cooling to room temperature. Examination by HPLC indicated greater than 99% one component that analyzed by both mass spectroscopy and NMR for A-20, 2-bromo-2-(4-methylphenyl) sulfonyl-N-(2-sulfoethyl)acetamide lithium salt.

Photographic Examples

EXAMPLE 5

Preparation of Emulsion AA

A chloroiodide silver halide emulsion was precipitated by equimolar addition of silver nitrate and sodium chloride into a well-stirred reactor containing gelatin peptizer and an antifoamant. A reaction vessel contained 5 L of a solution that was 7.9% in gelatin, 0.038 M in NaCl, and antifoamant. The contents of the reaction vessel were maintained at 67° C. and the pCl was adjusted to 1.7. To this stirred solution at 67° C. 17.5 mL of a solution 2.6 M in $AgNO_3$ and 23.55 mL of a solution 2.8 M in NaCl were added simultaneously at 35 mL/min for 0.5 minute. Then the 2.6 M silver nitrate solution and the 2.8 M sodium chloride solution were added simultaneously with a ramped linearly increasing flow from 35 mL/min to 123 mL/min over 20 minutes. The 2.6 M silver nitrate solution and 2.8 M sodium chloride solution were then added simultaneously at 123 mL/min for 42.5 minutes. Then emulsion was cooled down to 40° C. over 15 minutes. After 93 mol-% of total silver was precipitated, 200 mL of solution containing potassium iodide in an amount corresponding to 0.3 mol % of total silver precipitated was dumped to the reactor. The resulting emulsion was a cubic grain silver chloride emulsion of 0.56 μm in edgelength size. The emulsion was then washed using an ultrafiltration unit, and final pH and pCl were adjusted to 5.6 and 1.7, respectively.

Sensitization of Emulsion AA

The emulsion was optimally sensitized by customary techniques. For each sensitization, the sequence of chemical sensitizer, spectral sensitizer, and antifoggants addition were the same. Detailed procedures for each emulsion variation are described in the following example:

Part A1.1 A portion of silver chloroiodide Emulsion AA was optimally sensitized by the addition of the optimum amount of gold sensitizer, GS, followed by heat ramp up to 60° C. for 20 minutes. Then yellow spectral sensitizing dye, SD-1, was added followed by addition of the optimum amount of sodium thiosulfate. Then emulsion was cooled down to 40° C. in the presence of antifoggant, AF-1. This gave Emulsion A1.

Part A1.2 A portion of silver chloride Emulsion AA was sensitized identically as in Part A1.1 except that 0.05 mg/Ag mole of mercuric chloride was added as the first addendum in the sensitization. This gave Emulsion A2.

Part A1.3 A portion of silver chloride Emulsion AA was sensitized identically as in Part A1.1 except that 0.10 mg/Ag mole of mercuric chloride was added as the first addendum in the sensitization. This gave Emulsion A3.

Part A1.4 A portion of silver chloride Emulsion AA was sensitized identically as in Part A1.1 except that 0.50 mg/Ag mole of mercuric chloride was added as the first addendum in the sensitization. This gave Emulsion A4.

Part A1.5 A portion of silver chloride Emulsion AA was sensitized identically as in Part A1.1 except that 5 mg/Ag mole of Inventive antifoggant A-1 was added as the first addendum in the sensitization. This gave Emulsion A5.

Part A1.6 A portion of silver chloride Emulsion AA was sensitized identically as in Part A1.1 except that 50 mg/Ag of Inventive antifoggant A-1 mole was added as the first addendum in the sensitization. This gave Emulsion A6.

Part A1.7 A portion of silver chloride Emulsion AA was sensitized identically as in Part A1.1 except that 500 mg/Ag mole of Inventive antifoggant A-1 was added as the first addendum in the sensitization. This gave Emulsion A7.

Part A1.8 A portion of silver chloride Emulsion AA was sensitized identically as in Part A1.1 except that 1000 mg/Ag mole of Inventive antifoggant A-1 was added as the first addendum in the sensitization. This gave Emulsion A8.

These emulsions were then separately mixed with a yellow dye-forming coupler dispersion containing C-1 just prior to coating on resin coated paper support. The coatings were overcoated with a gelatin layer, and the entire coating was hardened with bis(vinylsulfonylmethyl)ether. These dried coatings contained 280 mg silver per square meter and 18.3 g C-1 per square meter. Exposure was with a 3000K tungsten source for 0.1 second, and development was obtained with RA-4 process. Speed was determined at a point on D-logE curve corresponding to 1.0 density, Toe was determined at a point on D-logE curve that was 0.3 logE less than 1.0 density, Shoulder was determined at a point on the D-logE curve that was 0.3 logE greater than 1.0 density. The data obtained from Emulsions A1 to A8 are summarized in Table 1. A value of "nr" means that the Dmin was too high to allow measurement.

TABLE 1

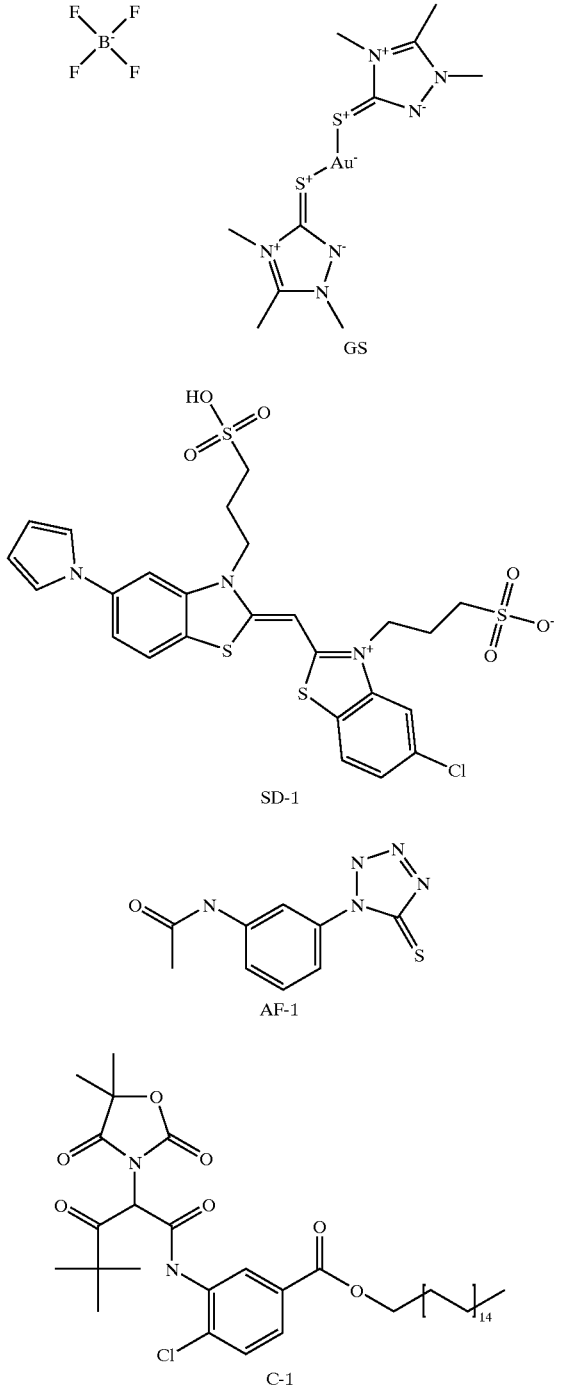

| Emulsion | Addendum | Level mg/Ag mol | Dmin | Speed | Toe | Shoulder |
|---|---|---|---|---|---|---|
| A1 (comparison) | none | none | 1.335 | nr | nr | nr |
| A2 (comparison) | $HgCl_2$ | 0.05 | 0.345 | 75 | 0.625 | 1.767 |
| A3 (comparison) | $HgCl_2$ | 0.10 | 0.301 | 79 | 0.618 | 1.742 |
| A4 (comparison) | $HgCl_2$ | 0.5 | 0.149 | 83 | 0.585 | 1.694 |

TABLE 1-continued

| | | | | | | |
|---|---|---|---|---|---|---|
| A5 (invention) | A-1 | 5 | 0.636 | 43 | 1.935 | 2.408 |
| A6 (invention) | A-1 | 50 | 0.205 | 73 | 0.569 | 2.296 |
| A7 (invention) | A-1 | 500 | 0.121 | 50 | 0.406 | 2.018 |
| A8 (invention) | A-1 | 1000 | 0.102 | 46 | 0.382 | 2.067 |

The results in Table 1 demonstrate the unexpected beneficial effects of Inventive antifoggant A-1 when added prior to the chemical sensitization of silver chloroiodide emulsion. These effects were not seen when Inventive antifoggant A-1 was added at the same levels after chemical sensitization. Furthermore, similar antifogging benefits were obtained relative to mercuric chloride, which alleviates the need for using environmentally undesirable antifoggants during emulsion manufacture. In general, gold(I)-sodium thiosulfate-sensitized silver chloroiodide cubic emulsions exhibit beneficial effects with Inventive antifoggant A-1 incorporation into the grain surface during sensitization. Emulsions sensitized in the presence of Inventive antifoggant A-1 produce about the same photographic response as emulsions sensitized in the presence of mercury salt; however, Inventive antifoggant A-1 in the gold(I)-sodium thiosulfate yellow sensitization significantly reduced fresh fog and decreased toe and favorably increased shoulder.

EXAMPLE 6

Preparation of Emulsion BB

This is a core/shell emulsion prepared as follows: Into a reaction vessel with good mixing was added 6.8 L of distilled water, 196 g of lime-processed, bone gelatin, 233.2 g of sodium bromide, 34 g of potassium iodide and antifoamant and, while keeping the temperature at 53° C., an aqueous solution consisting of 1.405 M silver nitrate was added at the rate of 125 mL/min. for 23.46 min. simultaneously with the addition of a solution consisting of 2.466 M sodium bromide containing 0.154 M potassium iodide and added at the rate of 141.7 mL/min. The addition of halide solution was then terminated and the addition of silver nitrate solution was continued for an additional 23.46 min. The vessel temperature was raised to 76° C. over a period of 11.5 min. and an aqueous solution of 19 g of sodium thiocyanate in 28 mL was then added. After a hold time of 25 min. the vessel was cooled to 45° C., and the excess salts were removed by ultrafiltration. The yield was 8.24 moles of a core/shell emulsion containing 8.2% iodide and with an average size of 1.04 $\mu$m. X-ray diffraction analysis revealed a core region containing 14% iodide and a shell region containing 5% iodide.

Sensitization of Emulsion BB

Emulsion BB was treated sequentially with potassium chloride; sodium thiocyanate; finish modifier, FM; yellow sensitizing dye, SD-2; gold sulfide; sulfur sensitizer, SS, as described by Burgmaier et al in US Pat. No. 4,810,626; and gold sensitizer, GS, as described by Deaton in US Pat. No. 5,049,485. The liquid emulsion was then incubated for 12 min. at 62° C. Following cooling to 40° C., the emulsion was treated with antifoggants, AF-2 and AF-1. This emulsion is denoted as BBS.

FM

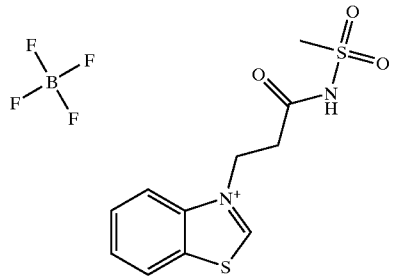

SD-2

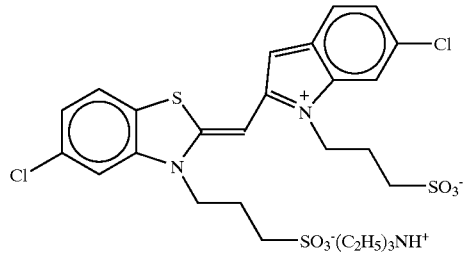

SS

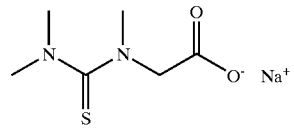

AF-2

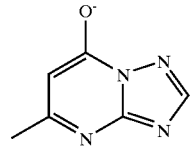

C-2

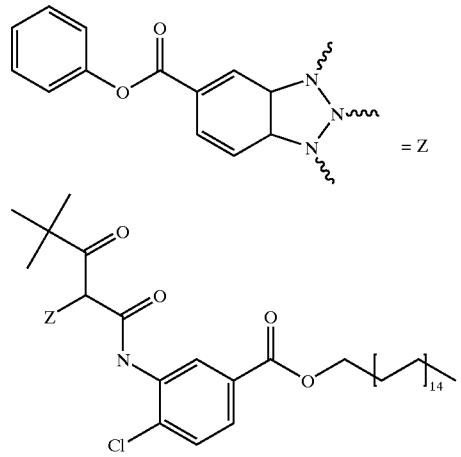

Photographic Evaluation

The sensitized emulsion samples described below were coated in a simple single layer format which consisted of a pad of gelatin on a cellulose acetate film support with an antihalation backing covered by a layer containing the emulsion and the yellow image forming coupler, C-1, together with a yellow development inhibitor releasing coupler, C-2. The emulsion layer was protected from abrasion by a gelatin overcoat containing hardener. A detailed description of the layered structure is described in Table 2. The dried coatings were exposed for 0.02 second, with a Wratten 2B filer using a 5500K light source and processed in a standard C-41 process. The corresponding data are summarized in Table 3. Dmin is the minimum optical density measured in an unexposed region of the film. Speed is measured as 100(1-logH) where H is the exposure in lux-sec necessary to produce a density 0.15 above Dmin.

Emulsion B1

The sensitized emulsion, BBS, was coated in the simple, single layer format described in Table 2. This emulsion is denoted as B1.

Emulsion B1-H

The sensitized emulsion, BBS, was melted and held for 3 hr. at 55° C. before being coated in a manner identical to Emulsion B1.

Emulsion B2-H

The sensitized emulsion, BBS, was treated identically to Emulsion B1-H except that before being held it was treated with 200 mg/mol of Inventive antifoggant A-1.

TABLE 2

| Coated Layer | Composition |
|---|---|
| Protective Overcoat | 2.15 g/m gelatin |
| Emulsion/Coupler | 3.23 g/m gelatin |
| | 0.86 $g/m^2$ Ag |
| | 1.08 $g/m^2$ coupler C-1 |
| | 0.032 $g/m^2$ coupler C-2 |
| | 0.004 $g/m^2$ antifoggant AF-2 |
| Gelatin Pad | 4.89 $g/m^2$ gelatin |
| Support | Cellulose Acetate |

TABLE 3

| Emulsion | Stabilizer | Treatment | Dmin | Speed |
|---|---|---|---|---|
| B1 (comparison) | None | None | 0.15 | 307 |
| B1-H (comparison) | None | 3 hr @ 55° C. | 0.36 | 287 |
| B2-H (invention) | A-1 | 3 hr @ 55° C. | 0.15 | 312 |

When the untreated, sensitized emulsion was heated for a prolonged time (B1-H), Dmin increased unacceptably and there was a substantial speed loss. However, treatment with Inventive antifoggant A-1 allowed the emulsion to be heated with no gain in Dmin and no loss in photographic speed. This type of behavior is desirable because it increases the lifetime of liquid emulsions during manufacture.

EXAMPLE 7

The emulsions used for graphic arts typically have cubic silver bromochloride grains, of edge lengths from 0.1 to 0.3 micrometers. Acceptably low fog can normally be achieved through use of disulfide antifoggants, e.g., compound DS-1, during the chemical sensitization of these emulsions, but increasing fog level can arise at longer time of development (TOD), especially after aging of the film, either at ambient temperature, or through elevated temperature accelerated keeping tests (AKT). This is particularly a problem for larger grained, efficiently sensitized emulsions, designed to be of high sensitivity for use with weak sources of exposing light. Use of increased levels of disulfide antifoggants, whilst controlling this fog, also cause a loss of sensitivity.

DS-1

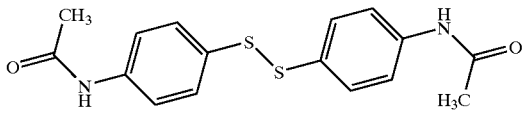

In this example a monodisperse AgBrCl emulsion (30:70 Br:Cl) having cubic grains of 0.21 micrometer edge length was prepared containing rhodium and iridium dopants uniformly precipitated throughout the grains, at $1.6\times10^{-7}$ moles Rh/mole Ag and $2.0\times10^{-7}$ moles Ir/mole Ag. The primitive emulsion was adjusted to pH 4.0 and pAg 7.2 at 40° C., after which 30 mg/Ag mole of Inventive antifoggant A-1 was added before chemically sensitizing by addition of 2.2 mg/Ag mole of antifoggant DS-1, 2.5 mg/mole of $Na_2S_2O_3.5H_2O$, and 2.5 mg of $KAuCl_4$, followed by a heat treatment at 65° C. for 20 minutes, to give emulsion Em-1. A separate batch of primitive emulsion was similarly treated, but without addition of Inventive antifoggant A-1, to give comparison emulsion Em-2.

The film coatings of this invention consisted of an ESTAR™ support, an antihalation layer on the back of the support on which was coated a latent image forming emulsion layer, a gel interlayer, and a protective supercoat. The emulsions prepared as described above were spectrally sensitized with 300 mg/Ag mole of Dye-1, and then coated as a latent-image Dye-1

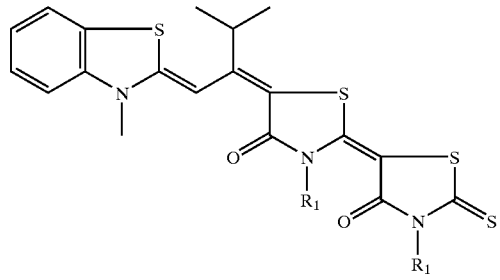

$R_1 = CH_2CO_2H$ forming emulsion layer at a laydown of 3.6 g $Ag/m^2$ in a vehicle of 2.1 $g/m^2$ gelatin and 1.0 $g/m^2$ latex copolymer of methyl acrylate, the sodium salt of 2-acrylamido-2-methylpropane sulfonic acid and 2-(methacryloyloxy)-ethylacetoacetate (88:5:7 by weight). Other addenda included 2-methylthio-4-hydroxy-5-carboxy-6-methyl-1,3,3a,7-tetraazaindene, 1-(3-acetamidophenyl)-5-mercaptotetrazole, and the nucleating agent (Nucleator-I), added at a laydown of 2.0 $mg/m^2$.

Nucleator-I

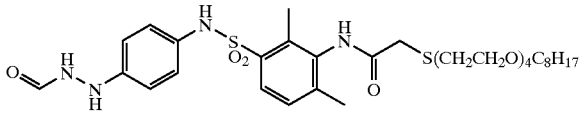

Simultaneously with this emulsion layer, an interlayer was coated at a gel laydown of 0.65 $g/m^2$ and including 5 $mg/m^2$ of a second nucleating agent (Nucleator-II) and 60 $mg/m^2$ amine booster (Booster I), and a protective supercoat containing matte beads and surfactant which was at a gel laydown of 1 $g/m^2$.

Nucleator-II

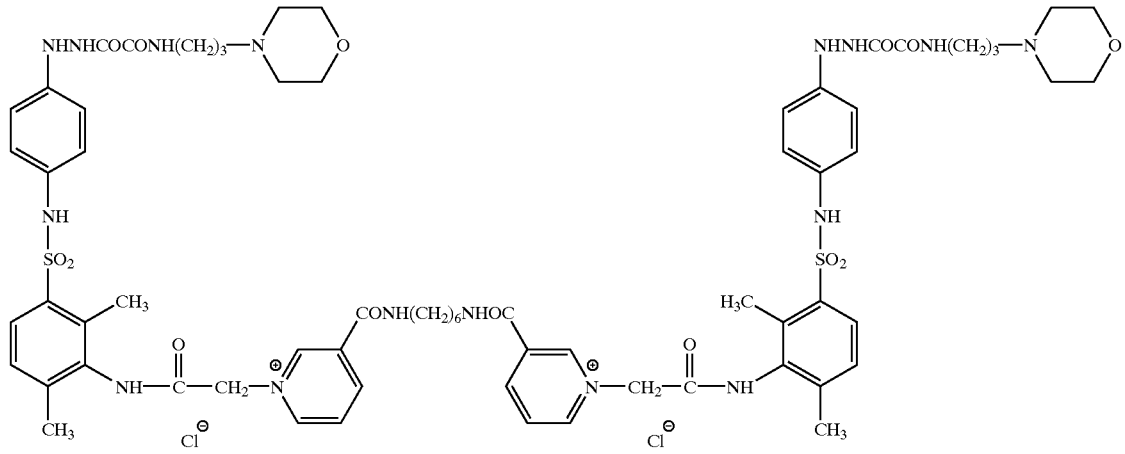

Booster I

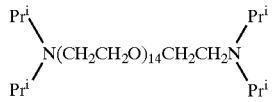

The coatings were exposed to a raster-scanning laser sensitometer giving a series of incremental exposures, starting from an area which received no exposure, and were processed in Kodak RA-2000™ chemistry at a series of different rates, giving times of development ranging from 25 to 40 seconds. Further samples of the films were incubated for 7 days at 50° C., after sealing in foil packets at 50% relative humidity, a test which is known to simulate the effect of approximately I year natural aging at 21° C., and these were processed similarly at the same range of development times. The coating 7-1, made from emulsion Em-1 containing Inventive antifoggant A-1, has a low Dmin under all processing conditions, except the most stressed condition of 40" TOD on the incubated sample. The comparison coating 7-2, made from emulsion Em-2, suffers an increase in Dmin with each incremental level of processing seventy, and fails completely under the most stressed condition. The sensitivities of the two coatings, expressed as relative logarithmic speeds are, however, the same, both in the toe and shoulder regions of the characteristic curve.

TABLE 4

Emulsions Sensitized with 1:1 Thiosulfate/Gold ratio

| Ex. | Emulsion | A-1 mg/Ag mole | Fresh Dmin 25" TOD | Incubated Dmin 25" TOD | Fresh Dmin 40" TOD | Incubated Dmin 40" TOD | Fresh speed (D = 0.6) 25" TOD | Fresh speed (D = 4.0) 25" TOD |
|---|---|---|---|---|---|---|---|---|
| 7-1 | Em-1 Invention | 30 | 0.019 | 0.021 | 0.021 | 0.033 | 0.56 | 0.42 |
| 7-2 | Em-2 Comparison | 0 | 0.023 | 0.027 | 0.033 | 0.088 | 0.57 | 0.41 |

This example shows that the addition of Inventive antifoggant A-1 to the emulsion is effective in reducing the level of fog resulting from film aging, whilst causing only minimal lowering of film sensitivity. Inventive antifoggant A-1 is used in conjunction with disulfide DS-1, which is added at a level low enough to not cause excessive desensitization, but insufficient to, by itself, totally prevent fog increase on film aging.

EXAMPLE 8

The primitive emulsion used in Example 7 was chemically sensitized by addition of varying amounts of compounds DS-1 and Inventive antifoggant A-1, followed by 1.9 mg/mole of $Na_2S_2O_3.5H_2O$, and 2.5 mg of $KAuCl_4$, followed by a beat treatment at 65° C. for 20 minutes, to give emulsions Em-3 to Em-5. The lower ratio of sulfur to gold in this example gives a less light-sensitive but more robust finish than in Example 7. These emulsions were coated and tested the same as in Example 7. The data in Table 5 show that coating 8-1, made with Em-3, containing a high level of Inventive antifoggant A-1, has a low Dmin under all conditions of incubation and time of development, but does not lose any speed compared to coating 8-2, which, containing only a low amount of Inventive antifoggant A-1 in Em-4, suffers Dmin rise under the most stressed conditions. Coating 8-3, of emulsion Em-5, which contains no Inventive antifoggant A-1, having instead a larger amount of the disulfide DS-1, also controls Dmin, but in this case there is a substantial loss in speed.

TABLE 5

Emulsions Sensitized with Lower Ratio of Thiosulfate to Gold

| Ex. | Emulsion | A-1 mg/Ag mole | DS-1 mg/Ag mole | Fresh Dmin 25" TOD | Incubated Dmin 25" TOD | Fresh Dmin 40" TOD | Incubated Dmin 40" TOD | Fresh speed (D = 0.6) 25" TOD | Fresh speed (D = 4.0) 25" TOD |
|---|---|---|---|---|---|---|---|---|---|
| 8-1 | Em-3 Invention | 25 | 2.2 | 0.017 | 0.019 | 0.019 | 0.025 | 0.49 | 0.35 |
| 8-2 | Em-4 Invention | 5 | 2.2 | 0.018 | 0.021 | 0.023 | 0.039 | 0.50 | 0.35 |
| 8-3 | Em-5 Comparison | 0 | 3.0 | 0.019 | 0.02 | 0.022 | 0.024 | 0.44 | 0.27 |

The invention has been described in detail with particular reference to certain preferred embodiments thereof, but it will be understood that variations and modifications can be effected within the spirit and scope of the invention.

What is claimed is:

1. A silver halide photographic element comprising at least one silver halide emulsion layer and further comprising an antifoggant represented by the following Structure I:

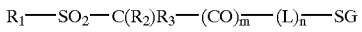

I wherein $R_1$ is an aliphatic or cyclic group, $R_2$ and $R_3$ are independently hydrogen or bromine as long as at least one of them is bromine, L is a divalent linking group, m and n are independently 0 or 1, and SG is a solubilizing group that has a pKa of 8 or less.

2. The silver halide photographic element of claim 1 wherein said SG is a phospho, sulfo, carboxy or sulfonamido group, or salt thereof.

3. The silver halide photographic element of claim 1 wherein said SG is a sulfo or carboxy group or salt thereof.

4. The silver halide photographic element of claim 1 wherein both $R_2$ and $R_3$ are bromine.

5. The silver halide photographic element of claim 1 wherein $R_1$ is a trifluoromethyl or a substituted or unsubstituted t-butyl or phenyl group.

6. The silver halide photographic element of claim 1 wherein m and n are each 1.

7. The silver halide photographic element of claim 1 wherein m and n are both 0.

8. The silver halide photographic element of claim 1 wherein m is 1 and n is 0.

9. The silver halide photographic element of claim 1 wherein m is 0 and n is 1.

10. The silver halide photographic element of claim 1 wherein n is 1 and L is a substituted or unsubstituted —NH-alkylene- group.

11. The silver halide photographic element of claim 1 wherein L is an aliphatic linking group.

12. The silver halide photographic element of claim 1 wherein said antifoggant is one or more of the following compounds A-1 to A-31:

A-1

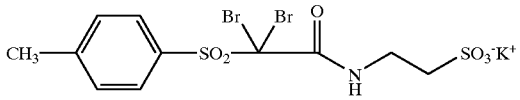

-continued

A-2

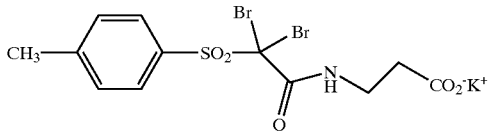

A-3

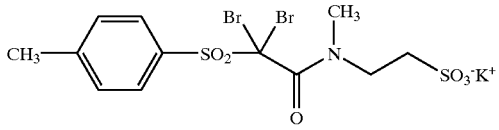

A-4

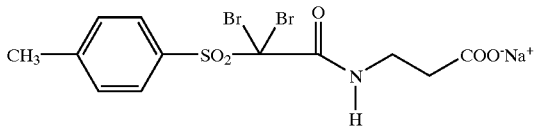

A-5

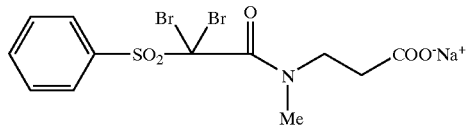

A-6

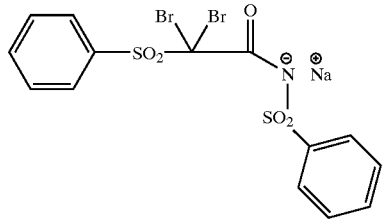

A-7

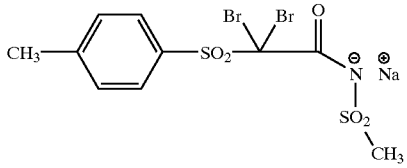

A-8

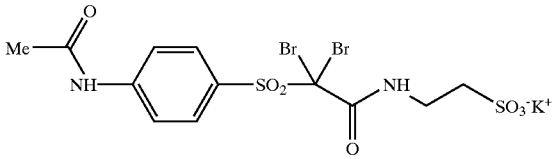

-continued
A-9
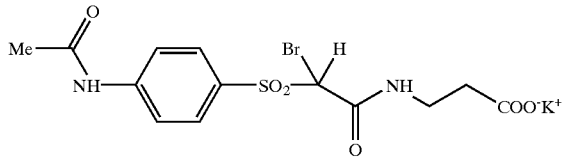
A-10
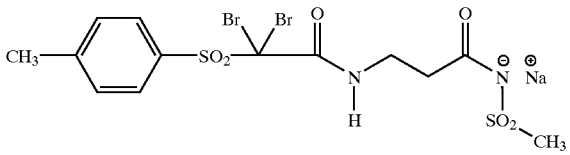
A-11
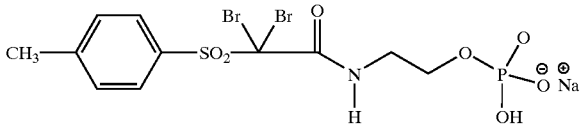
A-12
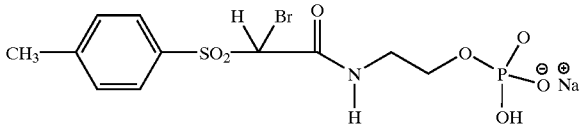
A-13
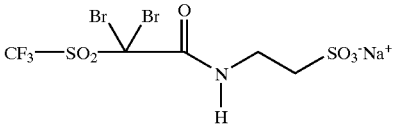
A-14
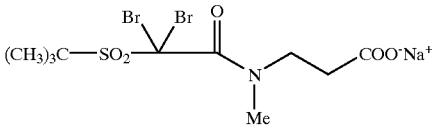
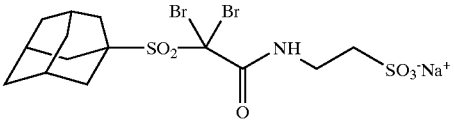
A-16
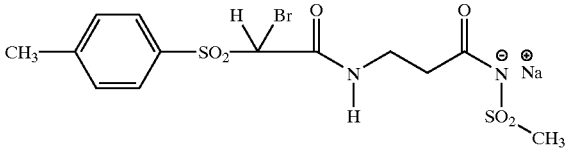
A-17
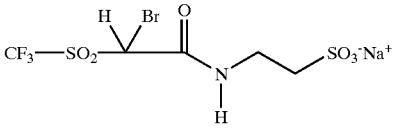
A-18
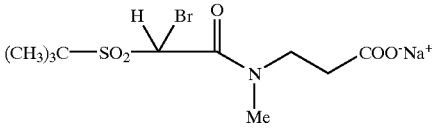
-continued
A-19
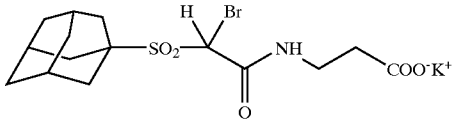
A-20
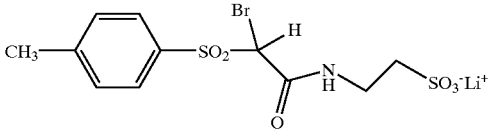
A-21
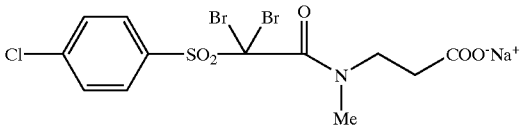
A-22
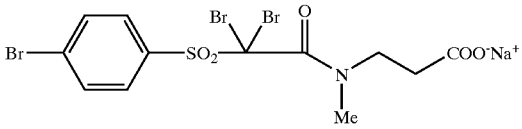
A-23
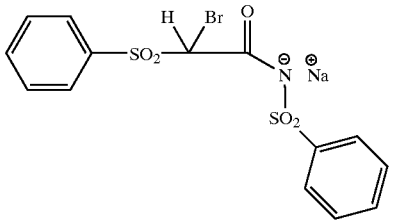
A-24
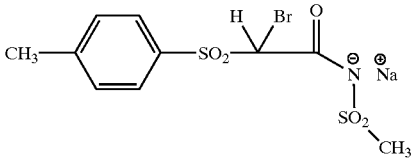
A-25
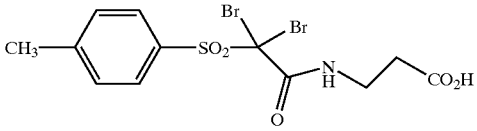
A-26
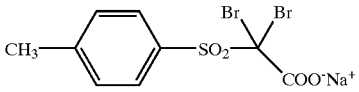
A-27
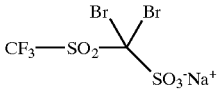
A-28
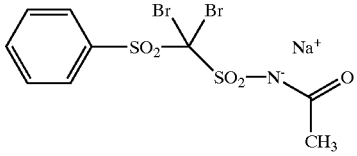

-continued

A-29

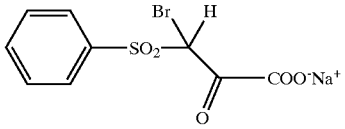

A-30

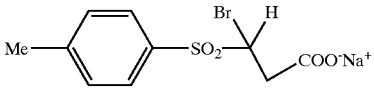

A-31

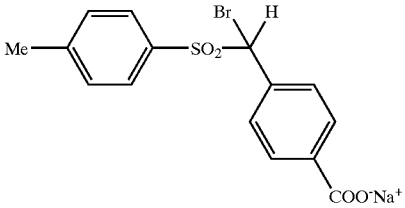

13. The silver halide photographic element of claim 1 wherein the silver halide element is black and white and contains a hydrazide nucleating agent.

14. The silver halide photographic element of claim 1 wherein the silver halide element further comprises a dye-forming coupler which reacts with an oxidized color developing agent to form dye.

15. The silver halide photographic element of claim 1 wherein the silver halide photographic element has a ratio of AgX/AgR>1.

16. A silver halide photographic emulsion comprising an antifoggant represented by the following Structure I:

$$R_1—SO_2—C(R_2)R_3—(CO)_m—(L)_n—SG \quad \text{I}$$

wherein $R_1$ is an aliphatic or cyclic group, $R_2$ and $R_3$ are independently hydrogen or bromine as long as at least one of them is bromine, L is a divalent linking group, m and n are independently 0 or 1, and SG is a solubilizing group that has a pKa of 8 or less.

17. The silver halide emulsion of claim 16 wherein said SG is a phospho, sulfo, carboxy or sulfonamido group, or salt thereof.

18. The silver halide emulsion of claim 16 wherein both $R_2$ and $R_3$ are bromine.

19. The silver halide emulsion of claim 16 wherein m and n are each 1.

20. The silver halide emulsion of claim 16 wherein m and n are both 0.

21. The silver halide emulsion of claim 16 wherein m is 1 and n is 0.

22. The silver halide emulsion of claim 16 wherein m is 0 and n is 1.

23. The silver halide emulsion of claim 16 wherein n is 1 and L is a substituted or unsubstituted —NH-alkylene-group.

24. The silver halide emulsion of claim 16 wherein L is an aliphatic linking group.

25. The silver halide emulsion of claim 16 wherein said antifoggant is one or more of the following compounds A-1 to A-31:

A-1

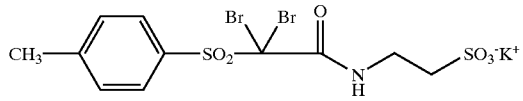

A-2

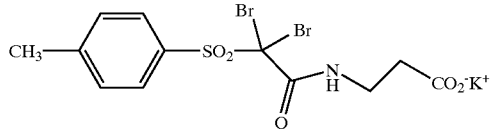

A-3

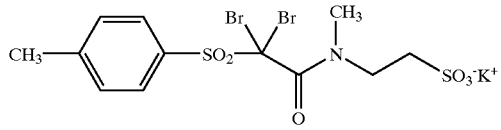

A-4

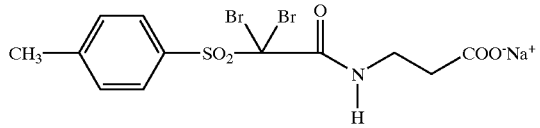

A-5

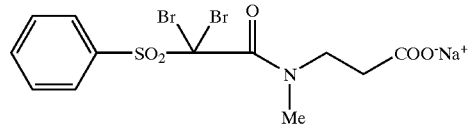

A-6

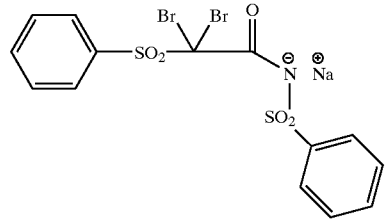

A-7

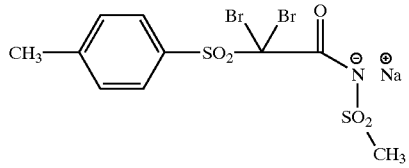

A-8

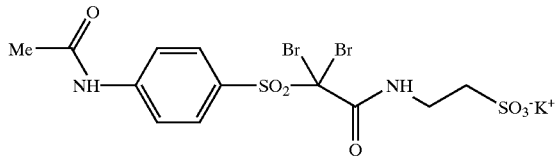

A-9

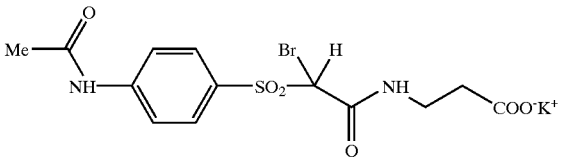

-continued
A-10
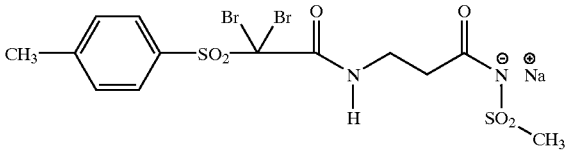
A-11
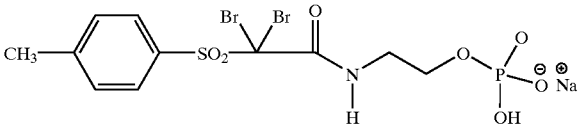
A-12
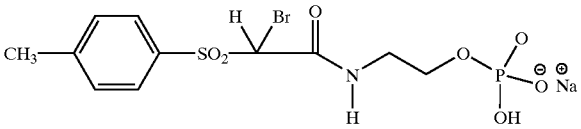
A-13
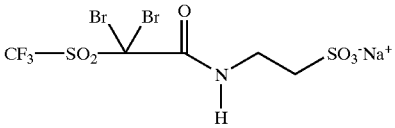
A-14
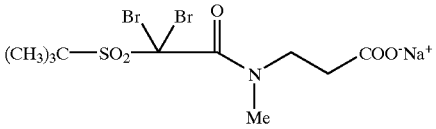
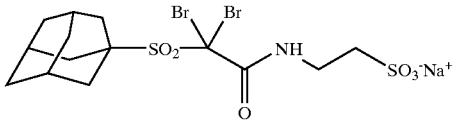
A-16
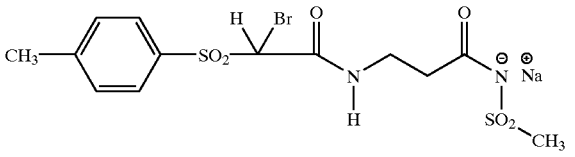
A-17
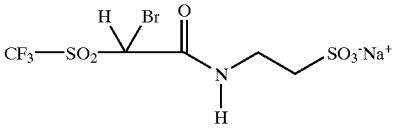
A-18
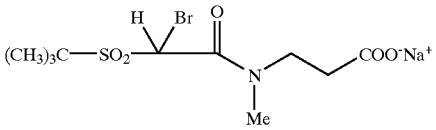
A-19
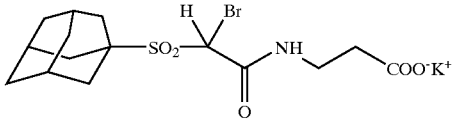
-continued
A-20
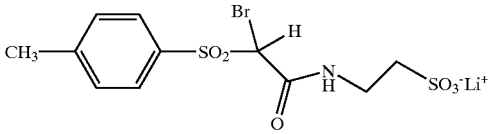
A-21
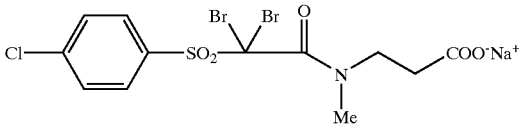
A-22
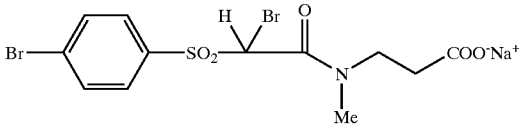
A-23
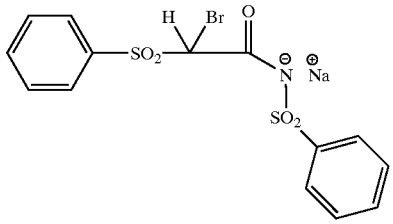
A-24
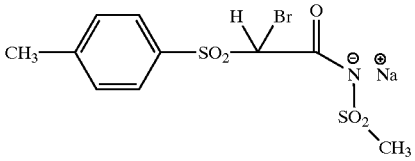
A-25
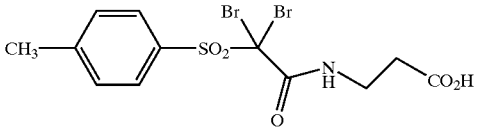
A-26
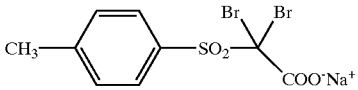
A-27
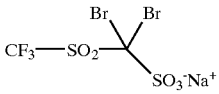
A-28
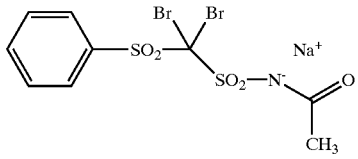

-continued
A-29
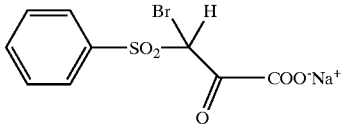
A-30
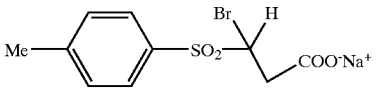
-continued
A-31
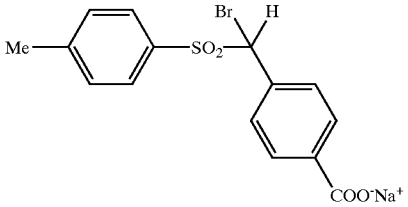
26. The silver halide photographic element of claim 13 wherein the silver halide element further comprises a dichalcogenide antifoggant compound.
* * * * *